United States Patent [19]

Kamada et al.

[11] Patent Number: 4,771,937

[45] Date of Patent: Sep. 20, 1988

[54] LID FOR HEAT-SEALING CONTAINER

[75] Inventors: Mamoru Kamada, Kitakatsuragi; Fumiaki Nagase, Kashiwara; Eiichi Takeuchi, Osaka; Toshihiko Nakano, Kashiwara, all of Japan

[73] Assignee: Toyo Aluminium Kabushiki Kaisha, Osaka, Japan

[21] Appl. No.: 21,860

[22] Filed: Mar. 4, 1987

[30] Foreign Application Priority Data

Mar. 6, 1986 [JP] Japan ..... 61-49995

[51] Int. Cl.[4] ..... B65D 5/64; B65D 81/20

[52] U.S. Cl. ..... 229/123.1; 229/123.2; 229/123.33

[58] Field of Search ..... 229/123.1, 123.2, 123.3, 229/125.01, 125.33; 206/601, 604, 607, 608

[56] References Cited

U.S. PATENT DOCUMENTS

| | | | |
|---|---|---|---|
| 3,194,479 | 7/1965 | Rumberger | 229/123.2 |
| 3,488,201 | 1/1970 | Pizarro | 229/123.1 |
| 3,498,525 | 3/1970 | Zinkgraf | 229/123.1 |
| 4,055,672 | 10/1977 | Hirsch et al. | 229/123.1 |
| 4,209,126 | 6/1980 | Elias | 229/123.2 |
| 4,531,668 | 7/1985 | Forbes, Jr. | 229/123.2 |

*Primary Examiner*—Willis Little

*Attorney, Agent, or Firm*—Armstrong, Nikaido, Marmelstein & Kubovcik

[57] ABSTRACT

An improved lid for heat-sealing a container is proposed which comprises a substrate and an outer peel layer laminated to the substrate through two adhesive layers, one of which has a weaker adhesion strength than the other. The substrate has a base sheet and is formed with such a discontinuous cut outlining an opening that a tear starting from the end of one cut will be received by the front end of a cut next to the cut, and a partial opening will be formed in the substrate.

7 Claims, 2 Drawing Sheets

LID FOR HEAT-SEALING CONTAINER

The present invention relates to a lid for heat-sealing a container made of paper, plastics, glass or ceramics, and more particularly to a lid adapted so that an opening can be formed only at a desired portion.

A lid of this type is known in which an opening is formed therein at a predetermined portion and is sealed with a label adapted to be peeled off when necessary. With this type of lid, the barrier property is bad at the portion where the label is sealed to the lid and the trouble of forming an opening in the lid and bonding a label to cover the opening incurs an extra cost.

With another prior art lid, cuts or perforations which outline an opening are provided, and a tab continuing to the cuts or perforations is pulled to tear the lid therealong. This type of lid also has several problems. The barrier property can be deteriorated because of the cuts or perforations and the lid is liable to be torn or broken at the cuts during handling.

An object of the present invention is to provide a lid which obviates the above said shortcomings and in which an opening can be formed at a desired position without impairing the barrier properties.

In accordance with the present invention, a less adhesive resin layer arranged at the interface of the adhesive layer allows the peel layer to peel off the substrate. At the opening-forming portion of a desired shape, where the special discontinuous through cuts are formed in the base sheet of the substrate, the substrate is pulled up with the peel layer, and torn apart along the cuts, forming a partial opening in the substrate. Such a partial opening cannot be formed if the cuts are ordinary perforations, because the substrate would be torn in the direction of peeling instead of along the cuts.

According to the present invention, the outside peel layer is laminated on the substrate, and the discontinuous cuts are formed in the substrate. Therefore, the barrier properties will not be impaired by the cuts and no breakage of the lid around the cuts might occur owing to any shock during handling. Further the outside peel layer covering the entire surface of the lid and having no opening formed therein provides protection of the lid from being opened in error by children.

One feature of the heat-sealed container using the lid according to the present invention is that is is retortable.

The metallic foil may be used as the outside peel layer to obtain perfect barrier properties because it is removed just before putting the container into a microwave oven for cooking.

Further, if the cuts are formed so as to extend as far as through the heat-sealing layer, even if the opening portion 7 should not be peeled off the substrate, these through cuts act as air vents, preventing the container from bursting while it is being cooked in a microwave oven.

Other features and objects of the present invention will become apparent from the following description with reference to the accompanying drawings, in which.

Figure 6A:
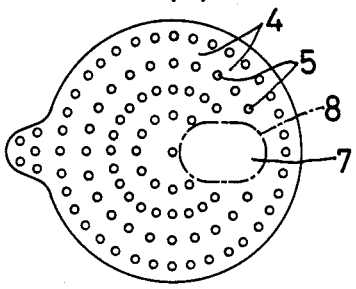
Figure 6B:
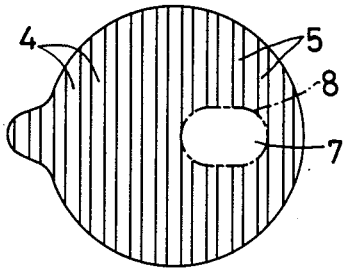
Figure 6C:
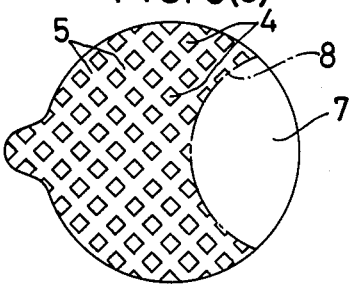
Figure 7A:
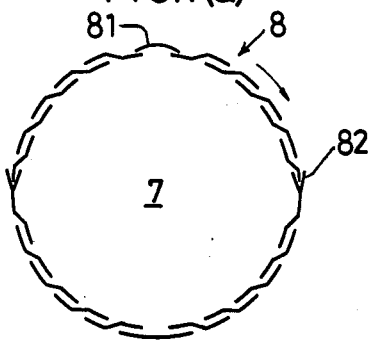
Figure 7C:
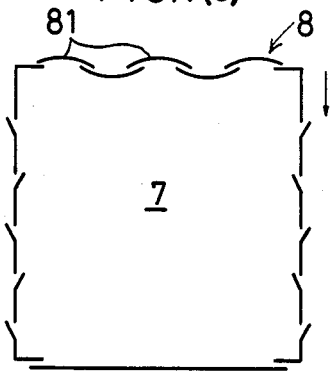
Figure 7B:
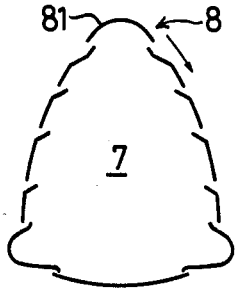
Figure 7D:
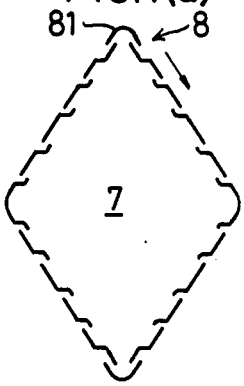
Figure 8:
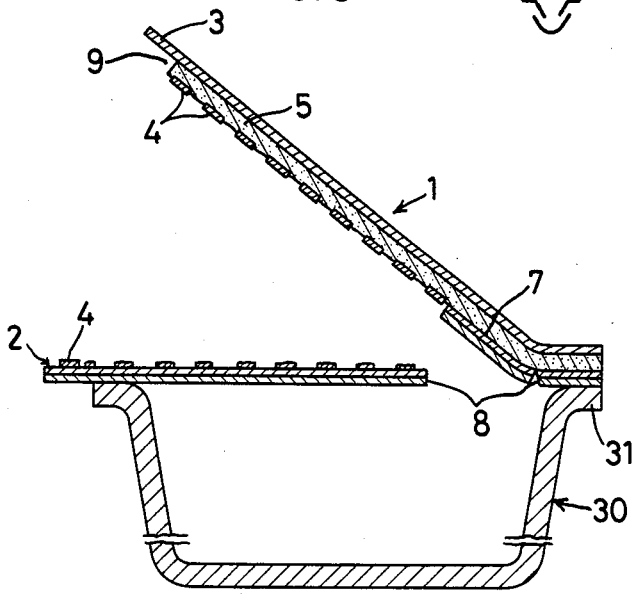

FIGS. 6(*a*)–6(*c*) are diagrammatic plan views showing patterns of the less adhesive resin layers in the lid;

FIGS. 7(*a*)–7(*d*) are plan views showing various shapes of the cuts by which the opening in the lid may be formed; and FIG. 8 is a sectional view showing a sealable container with its lid opened.

Figure 1:
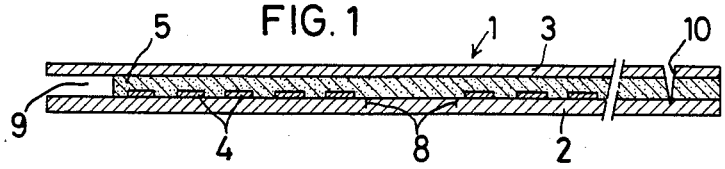
FIG. 1 is a sectional view of an embodiment of a lid according to the present invention.

Now referring to FIG. 1, a lid comprises a synthetic resin substrate 2 and an outside peel layer 3 laminated to the substrate 2 with an adhesive layer 4 having a relatively weak adhesion strength and an adhesive layer 5.

Figure 2:
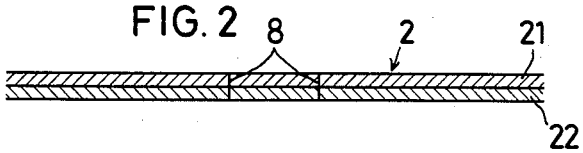
FIGS. 2 and 3 are sectional views showing the construction of the substrate used.

As shown in FIG. 2, the substrate 2 comprises a base sheet 21 of polyester, nylon (trade name), polypropylene film or paper and a heat-sealing layer 22 laminated to the outside surface of the base sheet 21. This layer 22 may be omitted if the base sheet 21 has heat-sealability.

Figure 3:
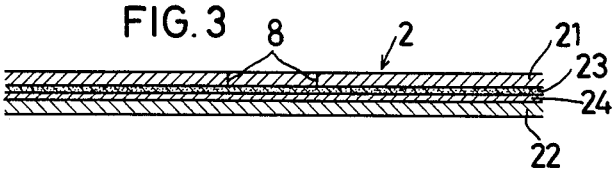

As shown in FIG. 3, a metallic film 24 such as a metallic foil or a metallized film may be laminated on the base sheet 21 through an adhesive layer 23 and the heat-sealing layer 22 may be laminated upon the outer surface of the metallic film 24.

Figure 4:
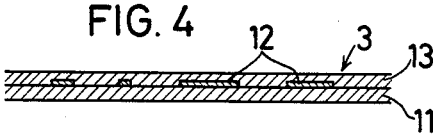
FIGS. 4 and 5 are sectional views showing the construction of an outer peelable layer.
Figure 5:
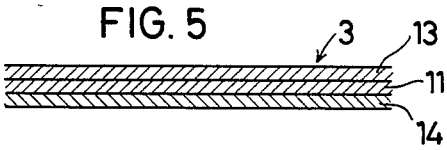

The outside peel layer 3 may be of a synthetic resin film, a metallic foil or a combination thereof. Examples are shown in FIGS. 4 and 5 in which numeral 11 designates a metallic film such as a metallic foil or metallized film, 12 does a printed layer, 13 does a surface protective layer and 14 does a reinforcing layer.

The resin layer 4 is made of a resin having a comparatively weak adhesion strength, such as acrylic resin, polyamide resin, silicone resin, vinyl resin or a combination thereof. The resin layer can be formed by coating such a resin partially. FIGS. 6(*a*), (*b*) and (*c*) show several patterns of the resin layer 4 thus formed. As shown, the area where the resin 4 is not coated may form a linear, dotted or lattice shape. In some cases the resin may be coated on the entire surface to form the resin layer 4. The layer 4 may be formed either on the substrate 2 as shown in FIG. 1 or on the peel layer 3. The point is that the resin layer 4 must exist on the interface between the adhesive layer 5 and the substrate 2 or the peel layer 3.

As the resin for the adhesive layer 5, a two-fluid curing-type adhesive such as ones in the polyurethane series is preferable, but any thermoplastic adhesive may be used.

The substrate 2 is formed with discontinuous cuts 8 extending at least through the base sheet 21 and outlining a portion 7 which will result in the opening of any desired shape. As shown in FIG. 7(*a*), the cuts 8 are arranged so that the rear end of every cut will overlap the front end of the cut formed immediately behind it in the direction of tear shown by arrow, so that the tear extending from each cut will be received by the next cut.

Or otherwise, the cuts 8 may be formed as shown in FIGS. 7(*b*), 7(*c*) and 7(*d*), so that the tear extending from the rear end of each cut will be received by the cut next to it.

The cut at a portion 81 from which tear is to be started should be arc-shaped. As shown in FIG. 7(*a*), at portions 82, a V-shaped cut is formed so that the tear extending from the rear end of the cut immediately before it will be received by it.

At the portion 7 partitioned with the cuts 8, the resin layer 4 may be provided to the same degree as the other portion, or may not be provided at all, or provided partially with a smaller ratio of the coated area to the non-coated area so that the adhesion strength between the peel layer 3 and the substrate 2 will be larger there than at the other area.

The cuts 8 may be arranged so as to surround the opening portion 7, as shown in FIGS. 6(*a*), (*b*), or may take the form of a curve terminating at the periphery of the lid 1, as shown in FIG. 6(*c*).

In order to facilitate the peeling of the outside peel layer 3 off the substrate 2, an adhesive-missing portion 9 should preferably be formed at the periphery of the lid 1, e.g., the portion corresponding to a tab, as shown in FIG. 1. Alternatively, a notch 10 may be formed to facilitate peeling of the peel layer 3.

One example of a sealable container using the lid 1 as described above is shown in FIG. 8.

As shown, a flange 31 is formed around the opening of a container body 30. The lid 1 is heat-sealed to the upper surface of the flange 31, forming a sealed container.

To remove the lid, the outside peel layer 3 at the adhesive-missing portion 9 is pinched and pulled upward. The peel layer 3 will be peeled from the substrate 2 as shown in FIG. 8 since the bonding strength between the substrate 2 and the peel layer 3 is not so firm owing to the existence of the less adhesive resin layer 4. However, at the opening-forming portion 7 where the bonding strength is higher and the cuts are formed therearound, the substrate 2 will be torn apart along the cuts 8 and pulled up together with the peel layer 3 and an opening will be formed.

What we claim is:

1. A lid for heat-sealing a container, comprising a substrate including a base sheet and having inner side thereof having a heat-sealability, and an outside peel layer laminated to said substrate thorugh a first adhesive layer and a second adhesive layer having a weaker adhesion strength than said first adhesive layer, said first adhesive layer covering the entire surface of said substrate but said second adhesive layer covering part of said first adhesive layer, said substrate being formed with discontinuous cuts arranged so as to enclose an opening portion, said cuts extending at least through said base sheet and being arranged so that a tear starting from the rear end of one cut will be received by the front end of a cut next to said one cut.

2. A lid as claimed in claim 1, wherein said substrate further comprises a heat-sealing layer.

3. A lid as claimed in claim 1, wherein said second adhesive layer is on said substrate.

4. A lid as claimed in claim 1, wherein said second adhesive layer is on said outside peel layer.

5. A lid as claimed in claim 1, wherein said second adhesive layer is absent from said opening portion.

6. A lid as claimed in claim 1, wherein said second adhesive layer is partially provided on said opening portion with a ratio of coated area to non-coated area smaller than such a ratio for the remainder of said substrate.

7. A lid as claimed in claim 1, wherein said first and second adhesive layers are arranged on said substrate such that adhesion strength between said substrate and said peel layer is greater on said opening portion than on the remainder of said substrate.

* * * * *